US006880270B2

(12) United States Patent
Prather

(10) Patent No.: US 6,880,270 B2
(45) Date of Patent: Apr. 19, 2005

(54) SHOE WITH MAGNETIC FASTENER

(76) Inventor: Suzanne K. Prather, 4870 NE. 27th Ter., Lighthouse Point, FL (US) 33064

( * ) Notice: Subject to any disclaimer, the term of this patent is extended or adjusted under 35 U.S.C. 154(b) by 0 days.

(21) Appl. No.: 10/396,021

(22) Filed: Mar. 24, 2003

(65) Prior Publication Data

US 2003/0221335 A1 Dec. 4, 2003

Related U.S. Application Data

(63) Continuation-in-part of application No. 09/904,135, filed on Jul. 13, 2001, now abandoned.

(51) Int. Cl.[7] ..... A43B 5/00; A43C 11/00; A44B 1/04; A44B 11/25

(52) U.S. Cl. ..... 36/50.1; 36/50.5; 24/303; 24/715.4

(58) Field of Search ..... 36/50.1, 50.5, 36/136, 132; 24/303, 715.4, 715.5, 715.6, 715.7

(56) References Cited

U.S. PATENT DOCUMENTS 4,450,633 A * 5/1984 Connelly ..... 36/50.1
4,646,350 A * 2/1987 Batra ..... 36/50.1
5,274,889 A * 1/1994 Morita ..... 24/303
5,307,582 A * 5/1994 Quintel ..... 24/303
5,873,183 A * 2/1999 Posner ..... 36/50.1
6,301,754 B1 * 10/2001 Grunberger et al. ..... 24/303
6,434,801 B1 * 8/2002 Grunberger ..... 24/303
6,532,687 B1 * 3/2003 Towns et al. ..... 24/303
6,606,767 B1 * 8/2003 Wong ..... 24/303
6,647,597 B1 * 11/2003 Reiter ..... 24/303
2002/0078596 A1 * 6/2002 Towns et al. ..... 36/50.1
2003/0005558 A1 * 1/2003 Wong ..... 24/303
2003/0019084 A1 * 1/2003 Wong ..... 24/303

* cited by examiner

*Primary Examiner*—Anthony Stashick
(74) *Attorney, Agent, or Firm*—Oltman, Flynn & Kubler

(57) ABSTRACT

An article of clothing includes flexible clothing sheet material having first and second sheet material ends which separate to pass a portion of a wearer body into and out of the article of clothing; and first and second magnetic fasteners which are magnetically attracted to each other and are secured to respective first and second sheet material ends for releasibly securing the sheet material ends together and thus securing the article of clothing around a portion of the wearer body.

3 Claims, 18 Drawing Sheets

SHOE WITH MAGNETIC FASTENER

This application is a continuation-in-part of application Ser. No. 09/904,135 filed on Jul. 13, 2001, now abandoned.

BACKGROUND OF THE INVENTION

1. Field of the Invention

The present invention relates generally to the field of wearing apparel, such as shirts, pants and shoes. More specifically the present invention relates to clothing having magnetic fasteners to releasibly secure the clothing around the body of a wearer. One embodiment of the invention is a shoe including a shoe outer surface and two opposing side regions and an inner flap having an inner flap magnetic panel and being secured to and extending from one of the side regions, and an outer flap having an outer flap magnetic panel and being secured to and extending from the opposing side region over the shoe so that the outer flap magnetic panel overlaps and magnetically engages the inner flap magnetic panel. The shoe alternatively has an upper, forward region, and the outer flap is secured to and extends from the upper, forward region. Other embodiments include belts and shirts having magnetic fasteners.

2. Description of the Prior Art

There have long been various fasteners for securing edges of clothing material together to fit and secure the article of clothing around a wearer body. Such prior fasteners have included buttons, zippers, shoe laces, snaps, ropes and hook and loop fasteners. A problem with these prior fasteners has been that many cannot be pulled apart quickly to free a person as may be required in certain circumstances in hazardous occupations and in emergencies. Another problem has been that most of these prior fasteners require a certain dexterity to operate which may be beyond the ability of persons infirm, aged or handicapped. Another problem is that the appearance of these fasteners cannot be changed without cutting fabric and re-sewing new fasteners to the clothing.

It is thus an object of the present invention to provide articles of clothing such as shoes with magnetic fasteners which can be pulled apart and re-fastened with speed and ease.

It is another object of the present invention to provide such articles of clothing with magnetic fasteners which can be fastened and unfastened without significant or complex manipulation.

It is still another object of the present invention to provide such articles of clothing with magnetic fasteners which radiate magnetic fields into the wearer body and thereby provide the health benefits of exposure to magnetic fields.

It is finally an object of the present invention to provide such articles of clothing with magnetic fasteners which are sturdy, aesthetically appealing and competitive in price to manufacture.

SUMMARY OF THE INVENTION

The present invention accomplishes the above-stated objectives, as well as others, as may be determined by a fair reading and interpretation of the entire specification.

An article of clothing is provided, including flexible clothing sheet material having first and second sheet material ends which separate to pass a portion of a wearer body into and out of the article of clothing; and first and second magnetic fasteners which are magnetically attracted to each other and are secured to respective first and second sheet material ends for releasibly securing the sheet material ends together and thus securing the article of clothing around a portion of the wearer body.

The flexible clothing sheet material optionally is configured to define a shoe, including a shoe outer surface and a shoe upper section having two inner flaps pivoting toward each other and an outer flap pivotally secured to the shoe outer surface and pivotable over the inner flaps; and the magnetic fasteners include an inner flap magnetic panel on each of the inner flaps and an outer flap magnetic panel on the outer flap positioned to be adjacent to the inner flap magnetic panels when the outer flap is pivoted over the inner flaps.

The shoe alternatively includes two inner flaps pivoting toward each other, each having an inner magnetic flap magnetic panel, where the outer flap pivots over both of the two inner flaps so that the outer flap magnetic panel releasibly engages the inner flap magnetic panels. Still alternatively, the shoe has two opposing side regions and the inner flap is secured to and extends from one of the side regions and the outer flap is secured to and extends from the opposing side region over the shoe so that the outer flap magnetic panel overlaps and magnetically engages the inner flap magnetic panel. The shoe preferably has an upper, forward region, and the outer flap is secured to and extends from the upper, forward region.

Where the flexible clothing sheet material is configured to define a shoe, the article of clothing alternatively includes a shoe top region divided by a longitudinal slit defined by two opposing slit edges, each slit edge having a series of adjacent shoelace passing ports; at least one shoelace threaded through opposing the shoelace passing ports, and a shoelace, and the magnetic fasteners include shoelace magnetic tip elements; and a shoelace tip engaging magnetic structure secured to the shoe top region for releasibly receiving and magnetically engaging the magnetic tip elements.

For another embodiment, the flexible clothing sheet material is configured to define a shirt, having a neck opening, arm openings and a shirt forward section with a longitudinal slit extending from the neck opening downward to define an outward section end for overlapping an inward section end; and the magnetic fasteners include an outward magnetic strip connected to the outward section end and an inward magnetic strip connected to the inward section end, so that when the outward section end overlaps the inward section end the outward magnetic strip is adjacent the inward magnetic strip and the outward magnetic strip releasibly engages the inward magnetic strip to hold the shirt forward section closed and the shirt secure around a wearer body.

The outward and inward magnetic strips optionally are periodically broken into discrete segments to visually resemble buttons. These discrete segments are preferably substantially dish-shaped and have thread passing ports for securing the discrete segments to the forward shirt section.

For another embodiment the flexible clothing sheet material is configured to define a belt, having an inward belt end and an outward belt end for overlapping the inward belt end; and the magnetic fasteners include an outward magnetic panel secured to the outward belt end and an inward magnetic panel secured to the inward belt end; so that the outward magnetic panel releasibly engages the inward magnetic panel with the force of magnetic attraction to hold the belt around a wearer waist. One of the magnetic panels preferably includes a stud bore in the outward surface and the other magnetic panel includes an inwardly directed stud which is sized, shaped and located to slide into the stud bore when the magnetic panels are positioned overlappingly and face to face, for absorbing tensile force in the belt. The outward magnetic panel preferably is configured to visually resemble a belt buckle.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
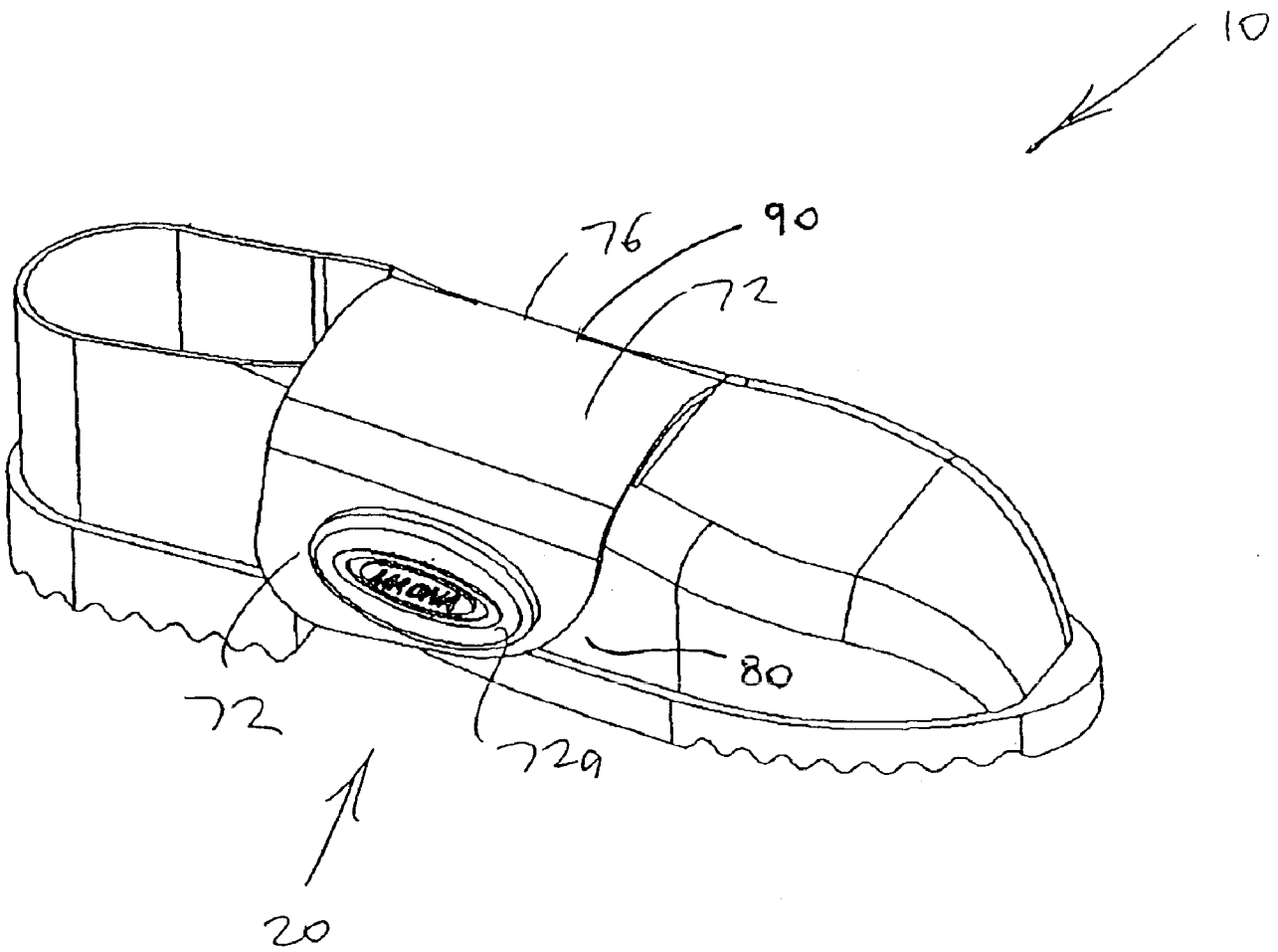
FIG. 1 is a side perspective view of the shoe having an outer flap secured to one side of the shoe, which wraps entirely over the top of the shoe and fastens to the opposing side of the shoe, where the magnetic panel on the inner flap in previously described versions is located.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
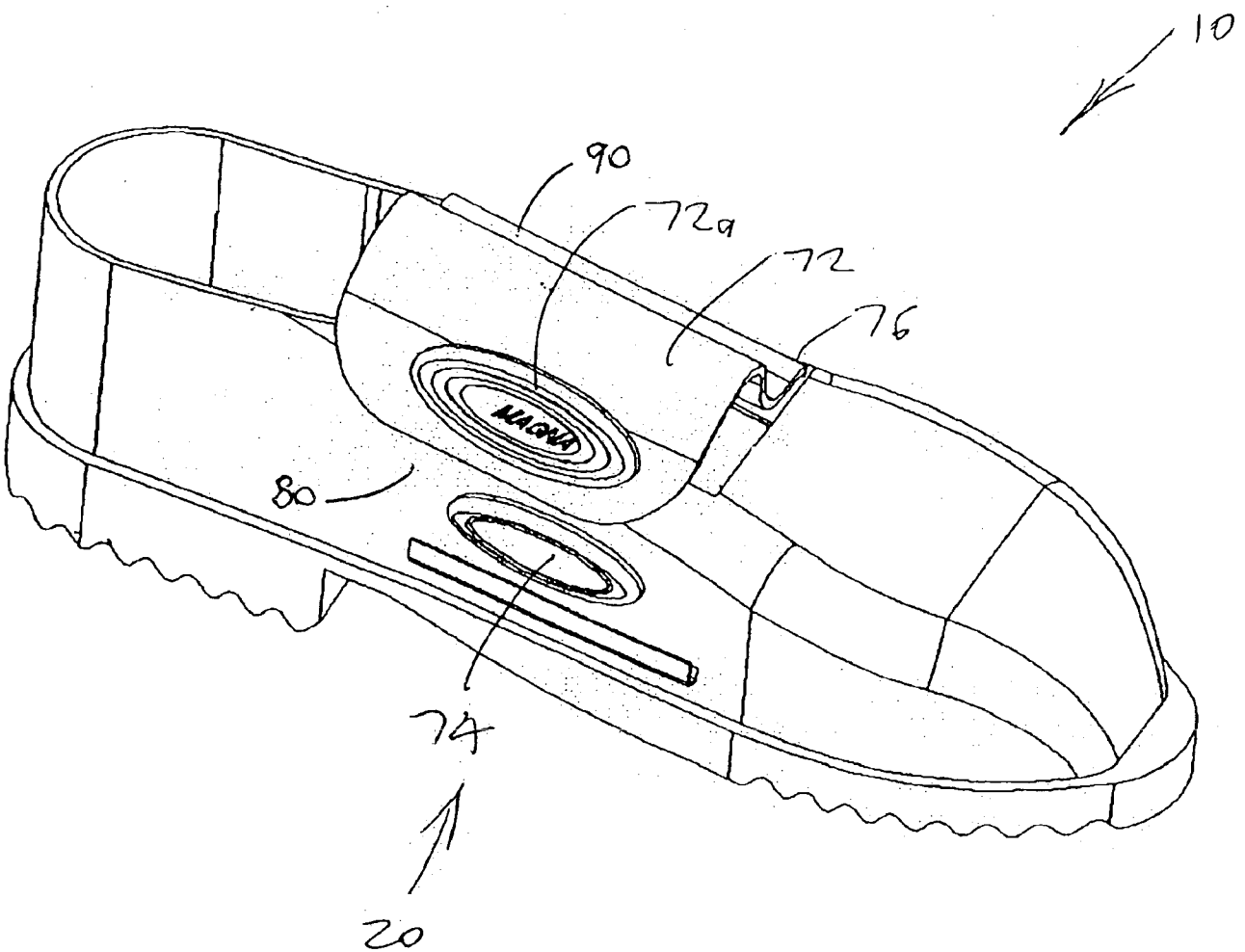
FIG. 2 is a view as in FIG. 1 with the outer flap lifted away from the magnetic panel on the side of the shoe.
Figure 3:
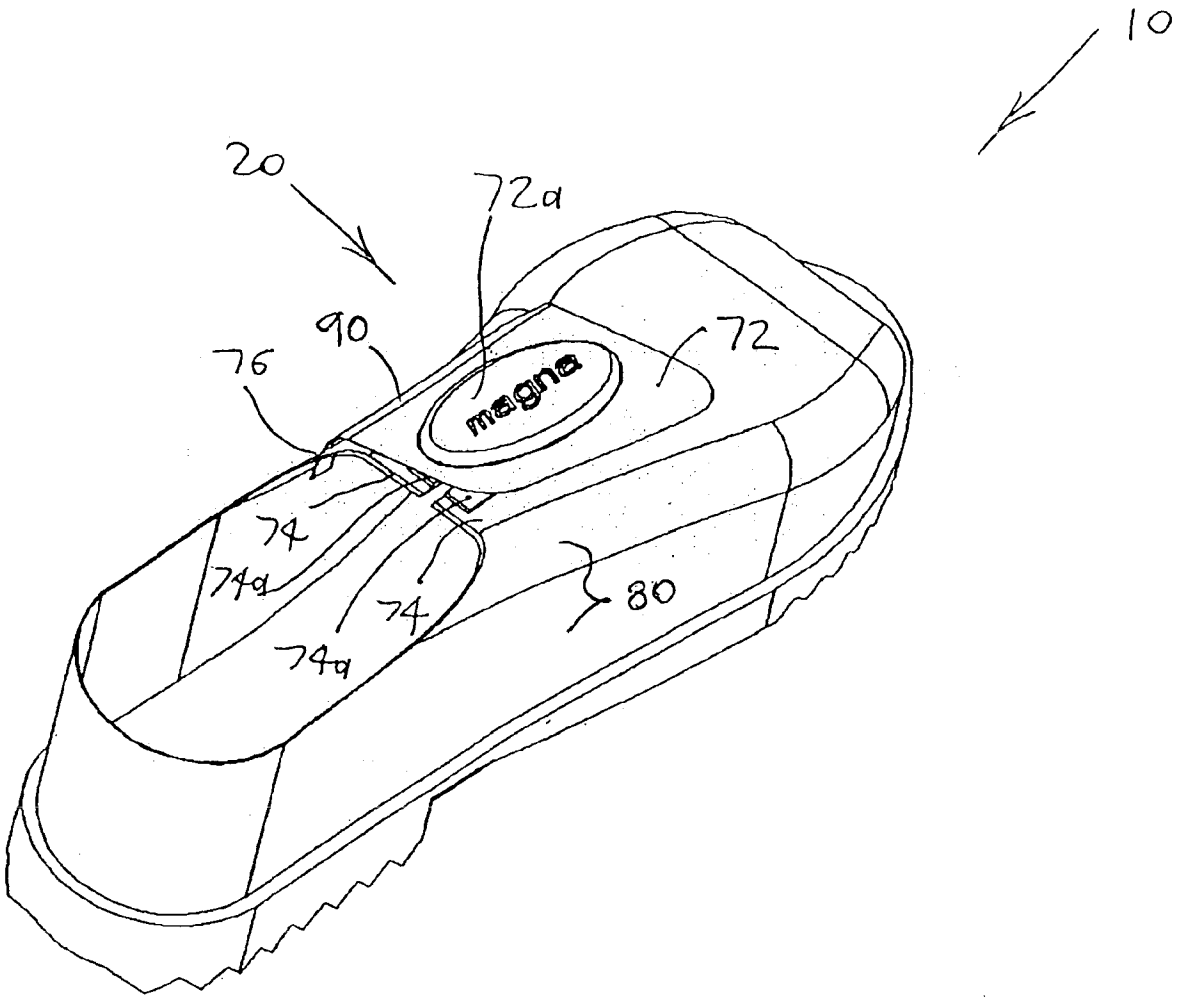
FIG. 3 is a perspective view of the shoe embodiment of the invention, with the opposing inner flaps having the inner flap magnetic panels covered by and engaging the side mounted outer flap having the outer flap magnetic panel.
Figure 4:
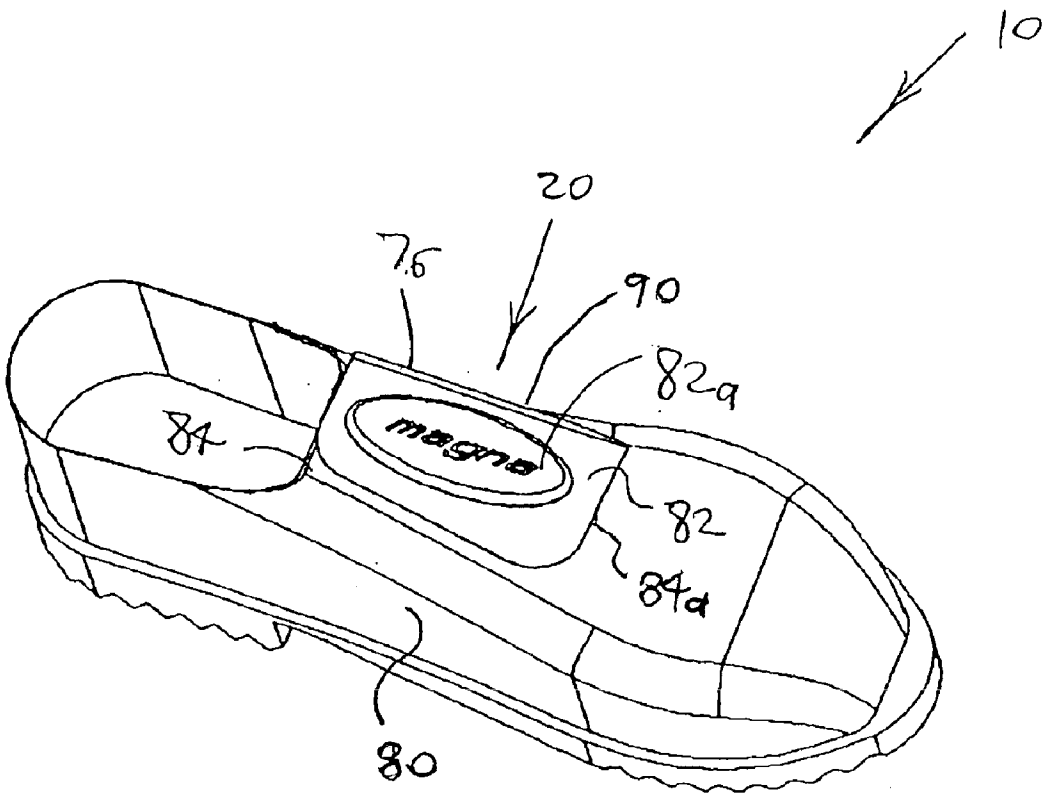
FIG. 4 is a top view of the shoe of FIG. 3.

Referring to FIGS. 1–18, articles of clothing 10 are disclosed having magnetic fasteners 20 for releasibly securing the given article of clothing 10 around a wearer body. A first embodiment of the invention is a shoe 10 having a magnetic fastener 20 in place of shoelaces. See FIGS. 1–8. Shoe 10 includes two opposing first and second side regions 80 and 90, respectively, and an inner flap 84 secured to the outward surface of, or itself constituting, the first side region 80 of the shoe 10 and having an inner flap magnetic panel 84*a* secured at the first side region 80, and an outer flap 82 secured to a pivot point on, or itself constituting, the second side region 90 of the shoe 10 and extending over the top of the shoe 10 so that its outer flap magnetic panel 82*a* overlaps and magnetically engages the inner flap magnetic panel 84*a* on the first side region 80. See FIGS. 1 and 2. This shoe construction, providing pivoting of outer flap 82 from the second side region 90 laterally over the top of the shoe 10 so that the outer flap magnetic panel 82*a* engages the inner flap magnetic panel 82*a* on the first side region 80, is a critical and superior shoe 10 configuration. Interconnected magnetic panels 82*a* and 82*b* are less likely to become unintentionally separated because of their position on a side region 80 or 90 of the shoe 10 and as a result the user foot does not more toward and bear directly against magnetic panels 82*a* and 82*b* as the user foot repeatedly rises against the top of the shoe 10 with the movements of walking or running. Another advantage is that only two, rather than three or more, magnetic panels are required, lowering manufacturing costs. Yet another advantage is that only one magnetic panel-to-magnetic panel junction is provided, rather than two or more, so that any panel to panel lateral slippage occurs only at one location, rather than being multiplied by two or more.

Alternatively, the single inner flap 84 is replaced with two shoe inner flaps 74 meet at the centerline of the top of the shoe 10, and each inner flap 74 has an inner flap magnetic panel 74*a* on its upper surface. A shoe outer flap 72 having an outer flap magnetic panel 72*a* on its inner surface is pivotally secured to the outer surface of the side region 76 of the shoe 10 and pivots to wrap over the two inner flaps 74. See FIGS. 1 and 2. To close the shoe 10 around a wearer foot, the inner flaps 74 are pivoted and pulled toward each other, and then the outer flap 72 is pivoted on top of inner flaps 74 so that the outer flap magnetic panel 72*a* meets and magnetically engages the inner flap magnetic panels 74*a*.

Figure 5:
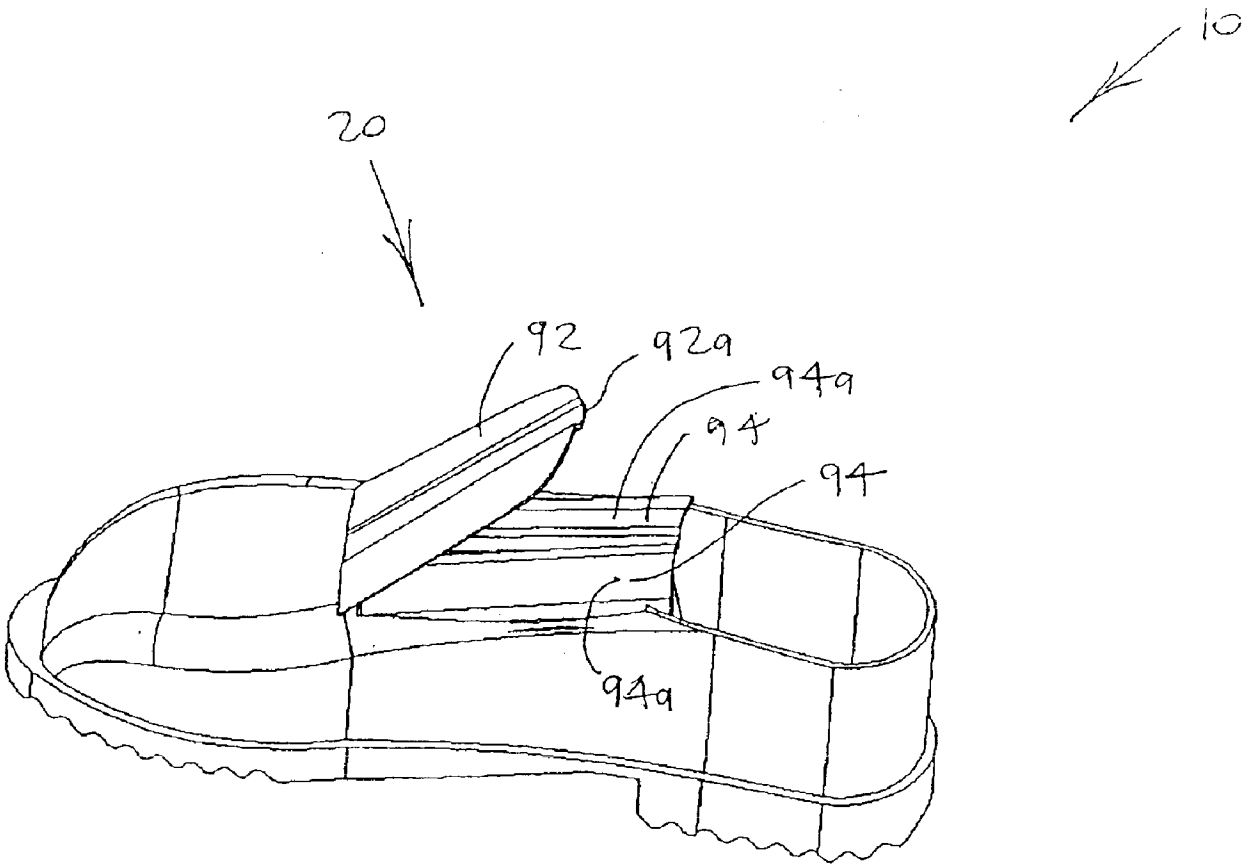
FIG. 5 is a side perspective view of an alternative version of the shoe embodiment, having the forward top mounted outer flap, with the outer flap pivoted to an open position.
Figure 6:
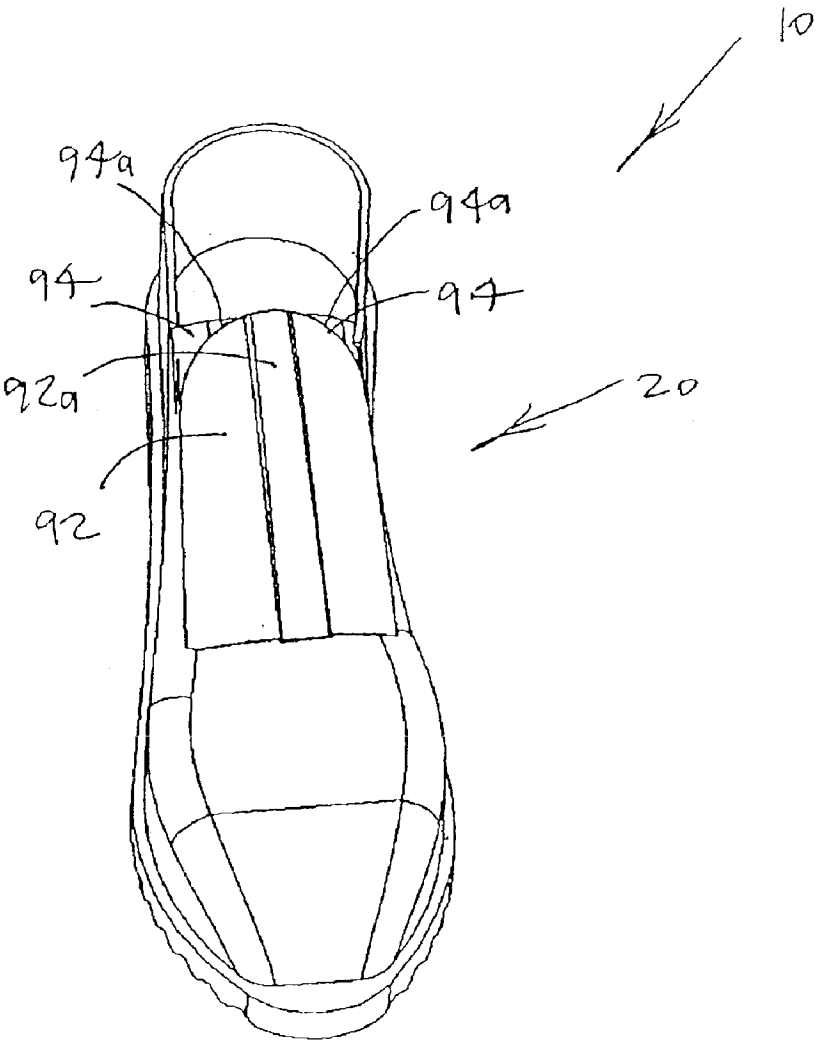
FIG. 6 is a top perspective view of the version of FIG. 13 with the outer flap pivoted to its closed position in contact with the inner flaps.
Figure 7:
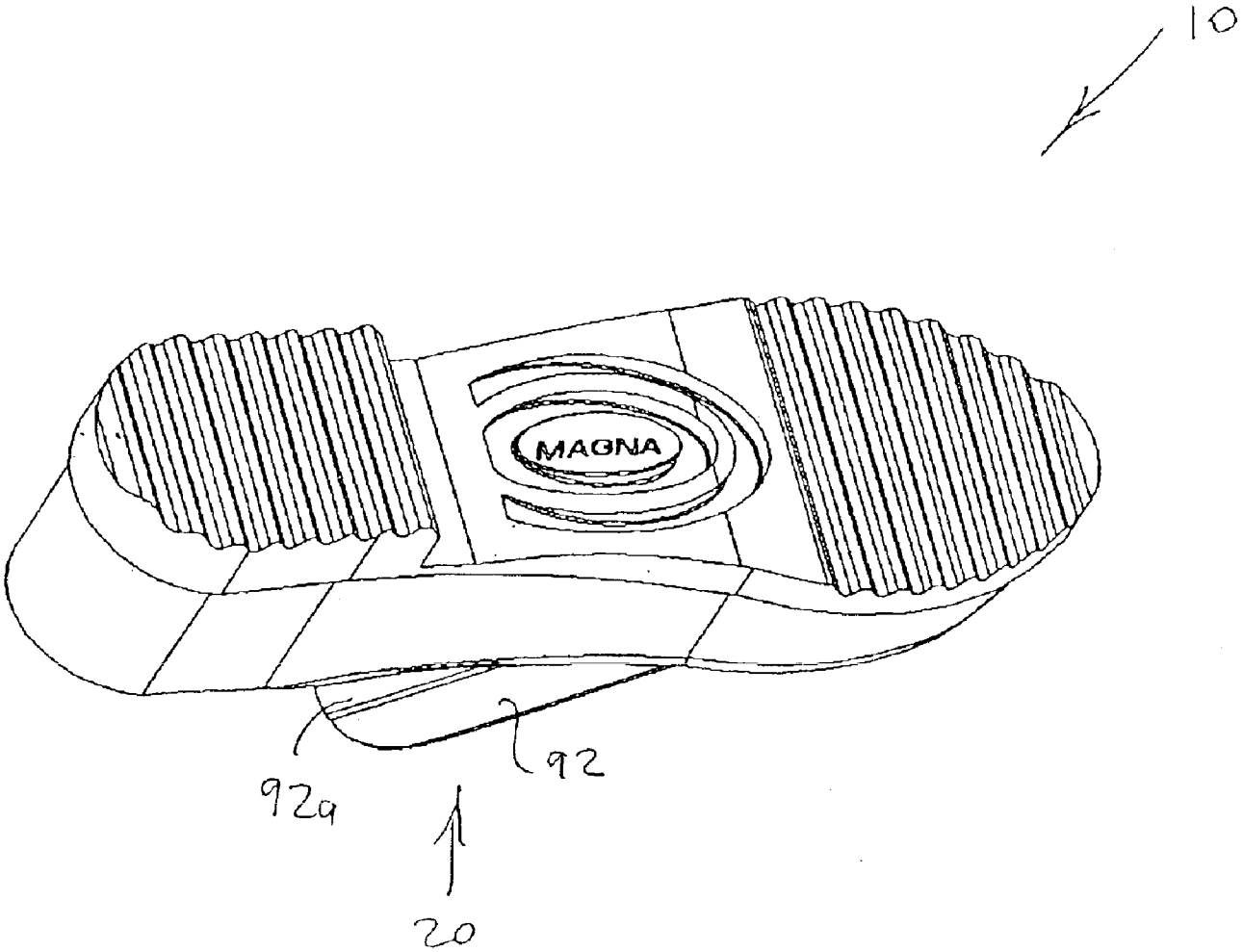
FIG. 7 is a bottom perspective view of the shoe embodiment, showing a preferred logo molded into its bottom surface.
Figure 8:
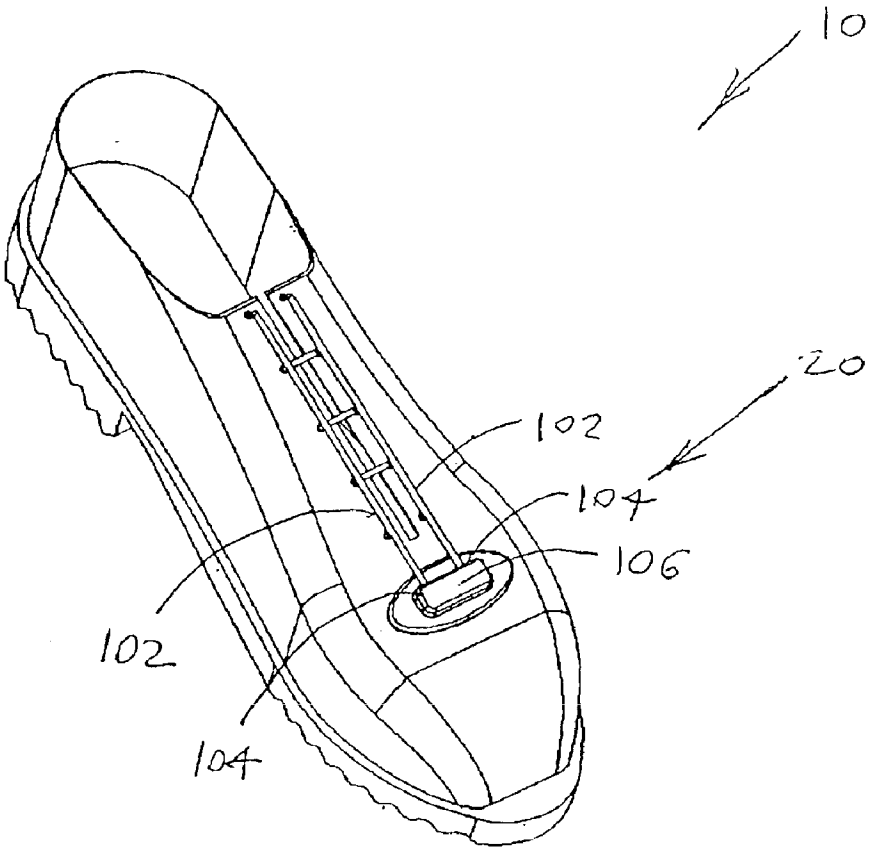
FIG. 8 is a top perspective view of yet another version of the shoe having conventional shoe laces, which are fitted with inventive lace magnetic tip elements releasibly engaged by a magnetic structure on top of the shoe.
Figure 9:
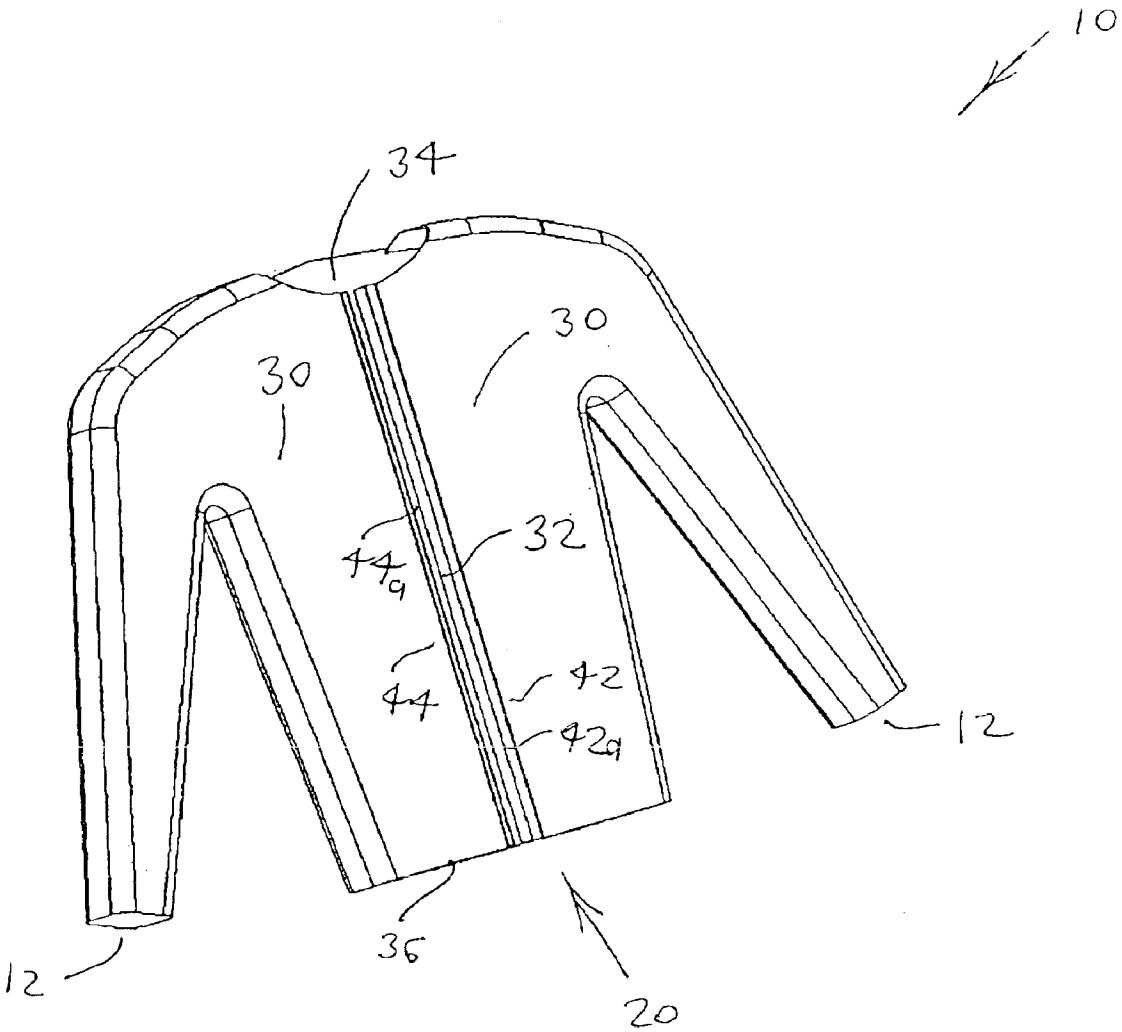
FIG. 9 is a front view of the shirt embodiment of the invention, having the continuous magnetic panel fasteners.

Still alternatively, an outer flap 92 having an outer flap magnetic panel 92*a* pivots from a point forward of the inner flaps 94 which have inner flap magnetic panels 94*a*, as shown in FIGS. 5 and 6, but otherwise operates analogously. FIG. 8 shows shoe laces 102 with magnetic tips 104 fitted into a recess in a magnetic tip receptacle 106.

Second Preferred Embodiment

Figure 16:
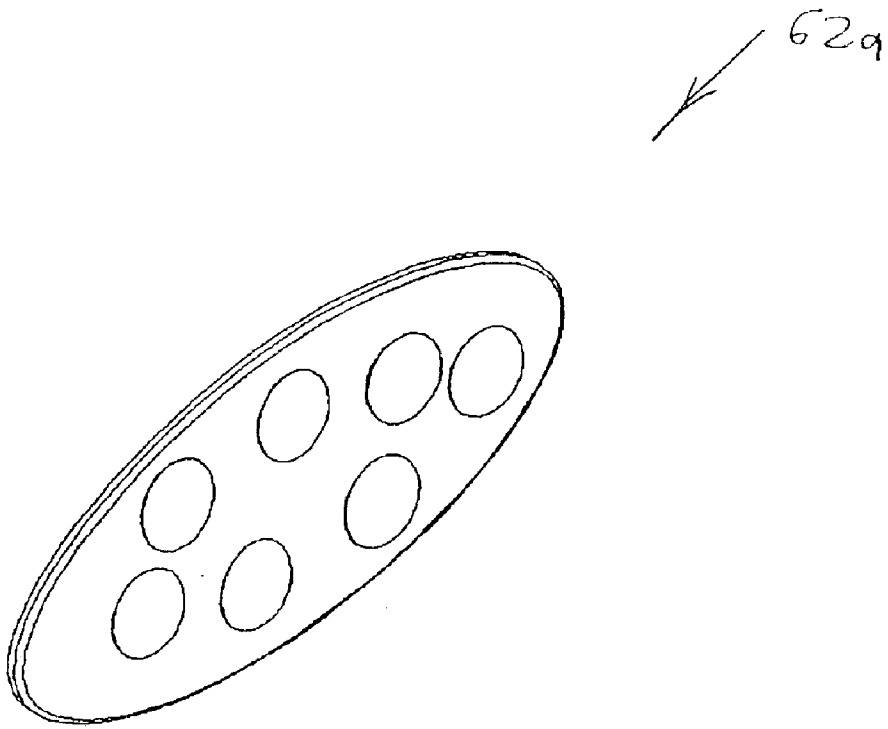
FIG. 16 is a perspective view of the outward face of the outward belt end magnetic panel, configured and marked to resemble a conventional belt buckle.
Figure 17:
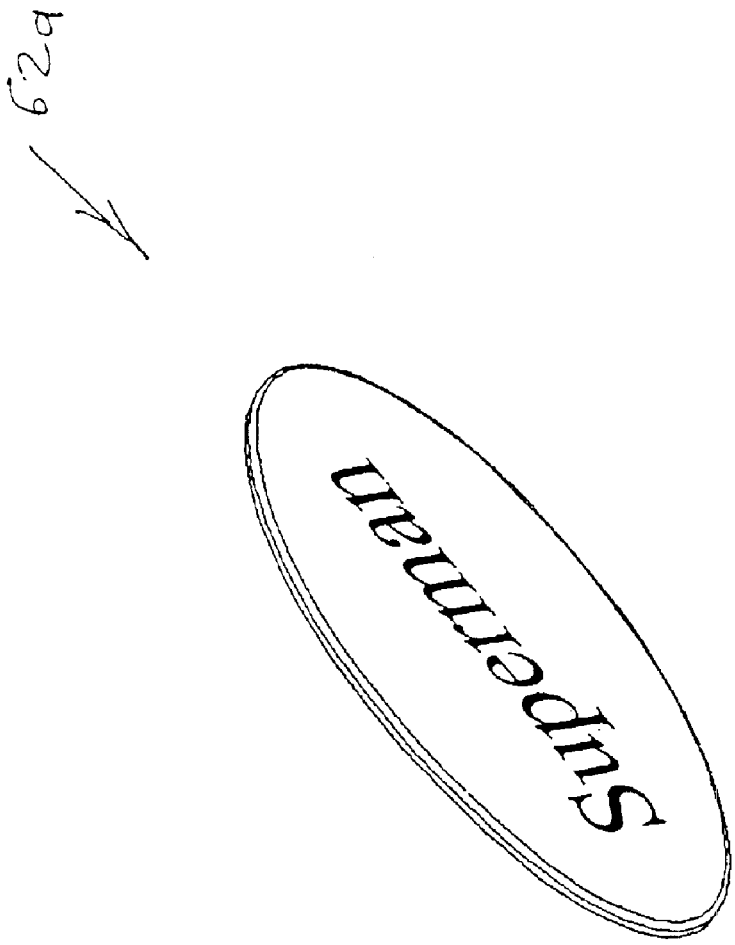
FIG. 17 is a perspective view of the outward belt end magnetic panel as in FIG. 16, with the markings spelling the word "Superman".
Figure 18:
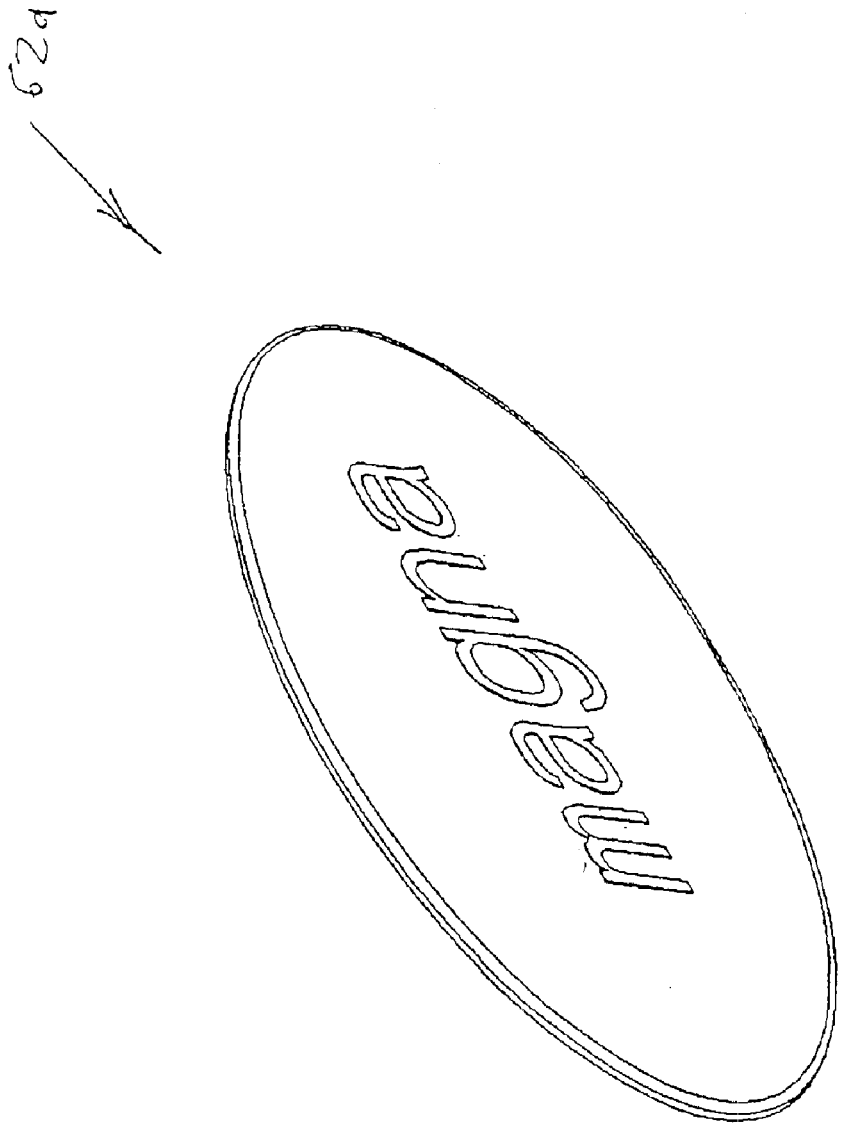
FIG. 18 is a perspective view of the outward belt end magnetic panel as in FIG. 8, with the markings spelling the word "Magna".

Another embodiment is a belt 10 having a magnetic fastener 20 in place of a latching buckle. The magnetic fastener 20 includes an outward belt end 62 with an outward magnetic panel 62*a* overlapping an inward belt end 64 with an inward magnetic panel 64*a*. See FIG. 13. Once again, the outward magnetic panel 62*a* releasibly engages the inward magnetic panel 64*a* with the force of magnetic attraction to hold the belt 10 around a wearer waist. Outer magnetic panel 62*a* preferably includes at least one and optionally two inwardly directed studs 66 which slide into correspondingly sized and located stud bores 68 in the outward surface of the inward magnetic panel 64*a*, to counteract any tensile force in the belt which might exceed the magnitude of the fastening magnetic force and might otherwise cause magnetic panels 62*a* and 64*a* to separate. See FIGS. 14 and 15. Outward magnetic panel 62*a* is preferably shaped and marked to resemble a conventional belt buckle. FIGS. 16–18, for example, show an oval perimeter outward magnetic panel 62*a* alternatively having a geometric pattern and the words "Superman" and "Magna" printed on its outward surface.

Third Preferred Embodiment

Figure 10:
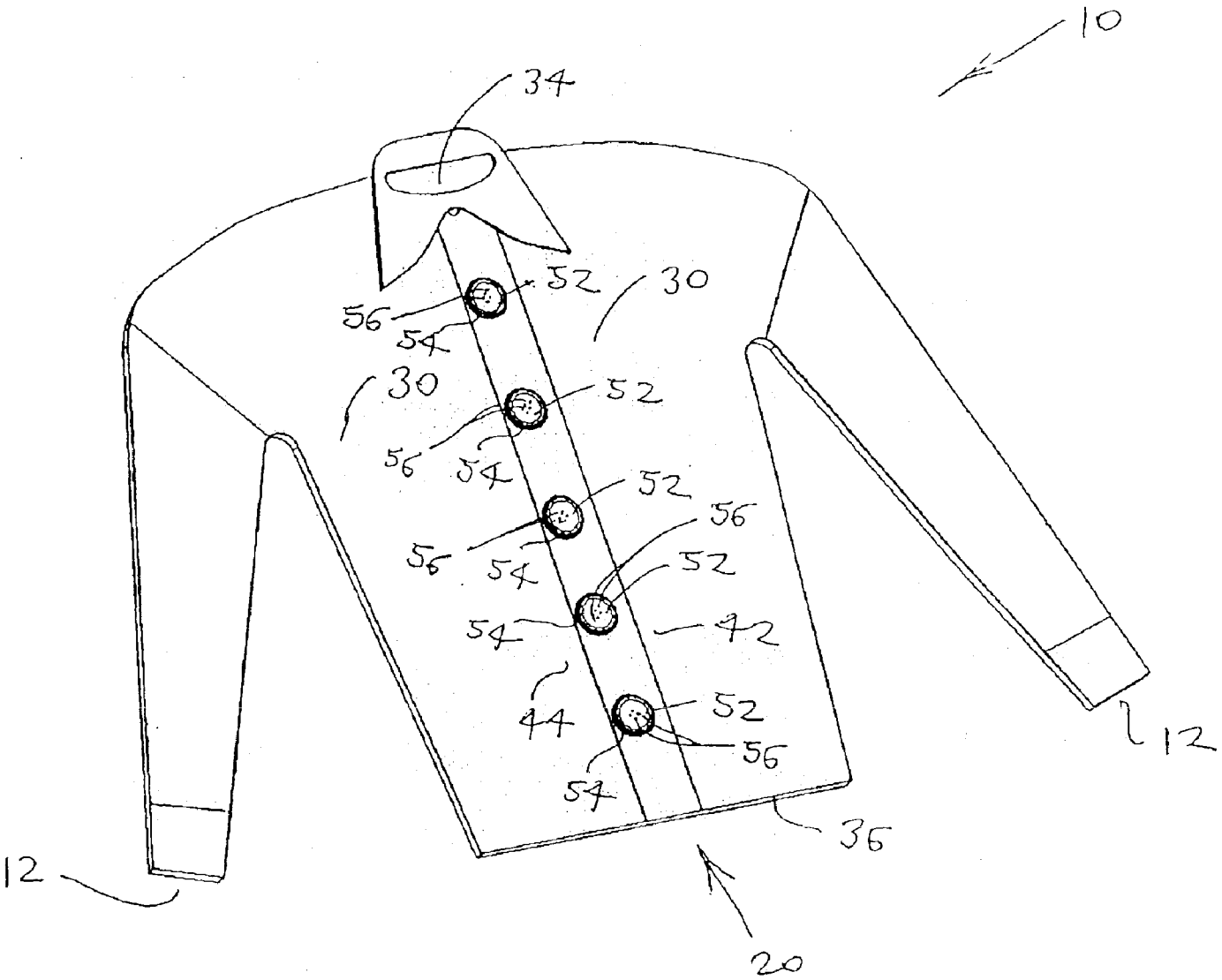
FIG. 10 is a front view of the shirt embodiment having the discrete segment magnetic panel fasteners shaped as conventional buttons. While not shown, it is also contemplated that such discrete segment fasteners be used at cuffs and collars in place of conventional buttons.
Figure 11:
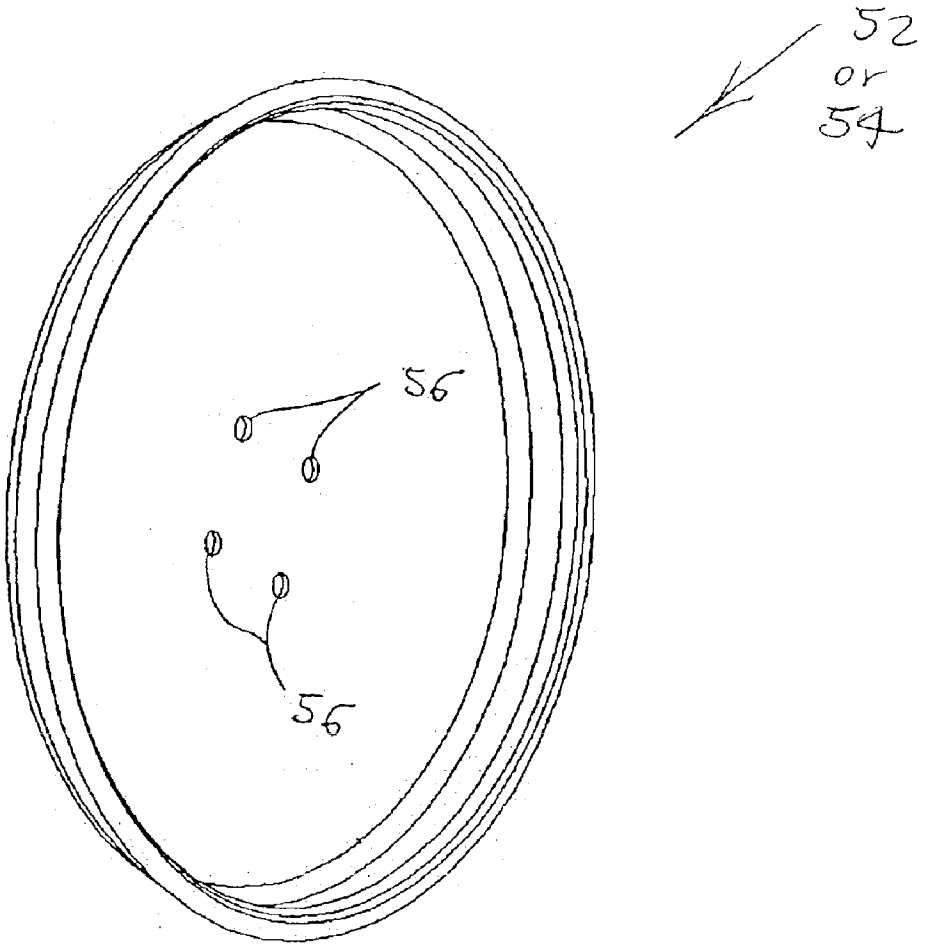
FIG. 11 is a perspective view of one of the button-shaped discrete segment magnetic fasteners, showing the thread passing ports for sewing the fastener onto an article of clothing, such as a shirt.
Figure 12:
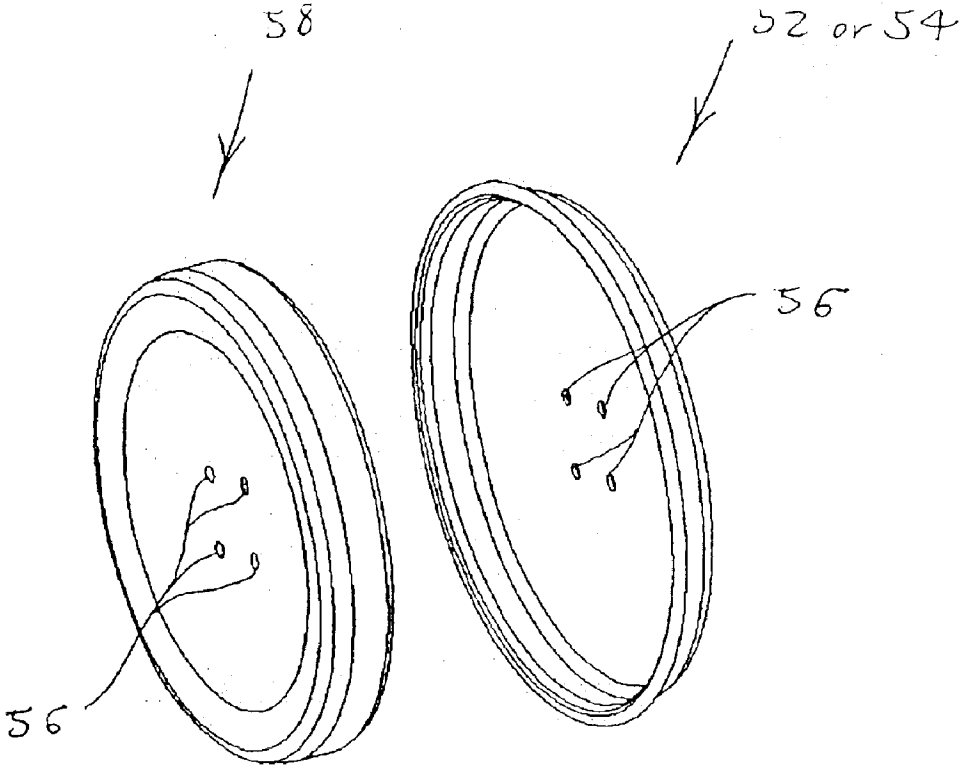
FIG. 12 is a perspective view of the button-shaped discrete segment magnetic fastener of FIG. 11 placed adjacent to a mating ornamental cap, the two being releasably interlockable along their annular flanges as one of these flanges snaps into the other, so that a discrete segment fastener having depth can be constructed.
Figure 13:
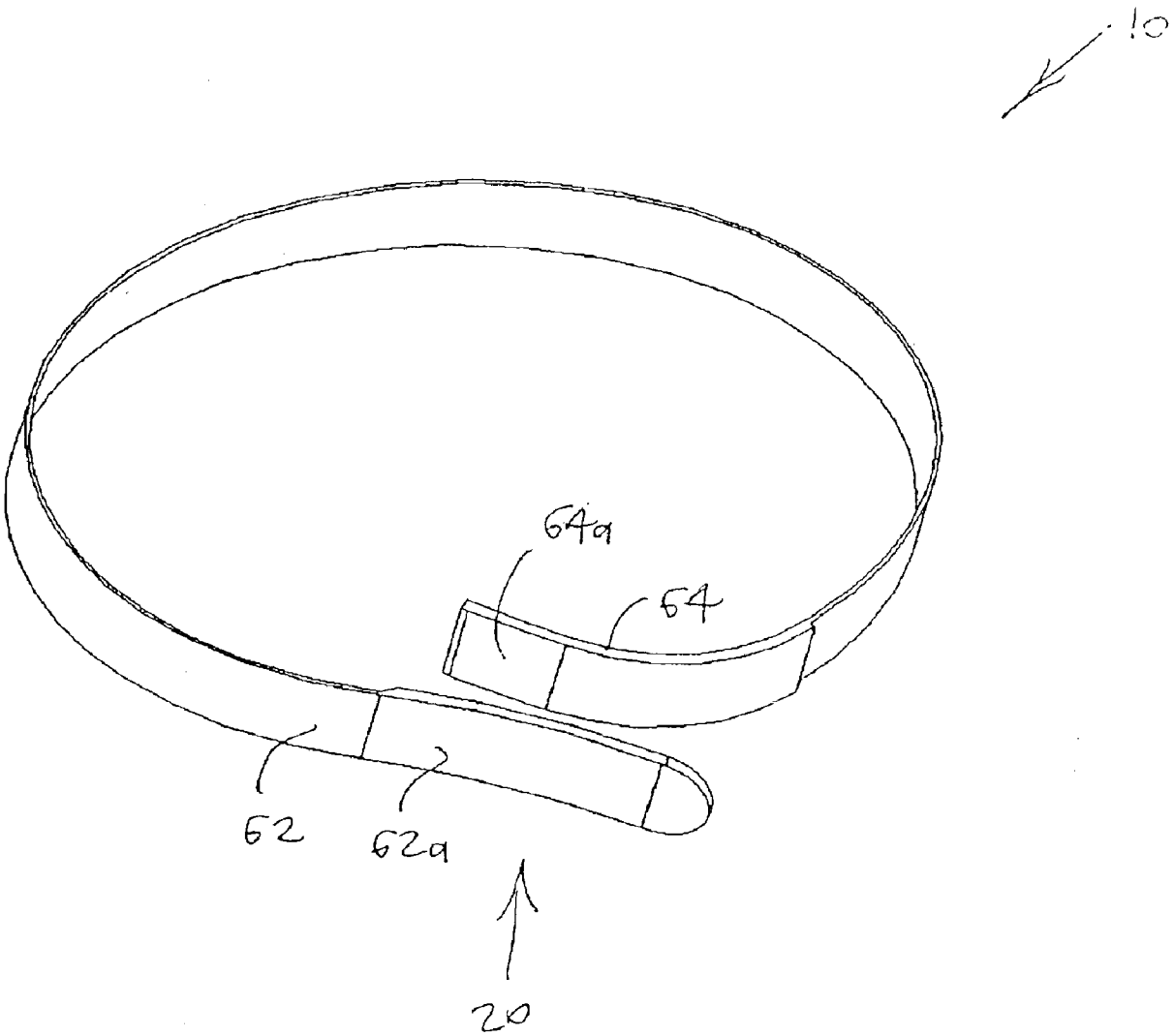
FIG. 13 is a perspective view of the belt embodiment of the invention, with the overlapping inward and outward belt ends and corresponding inward and outward magnetic panels.
Figure 14:
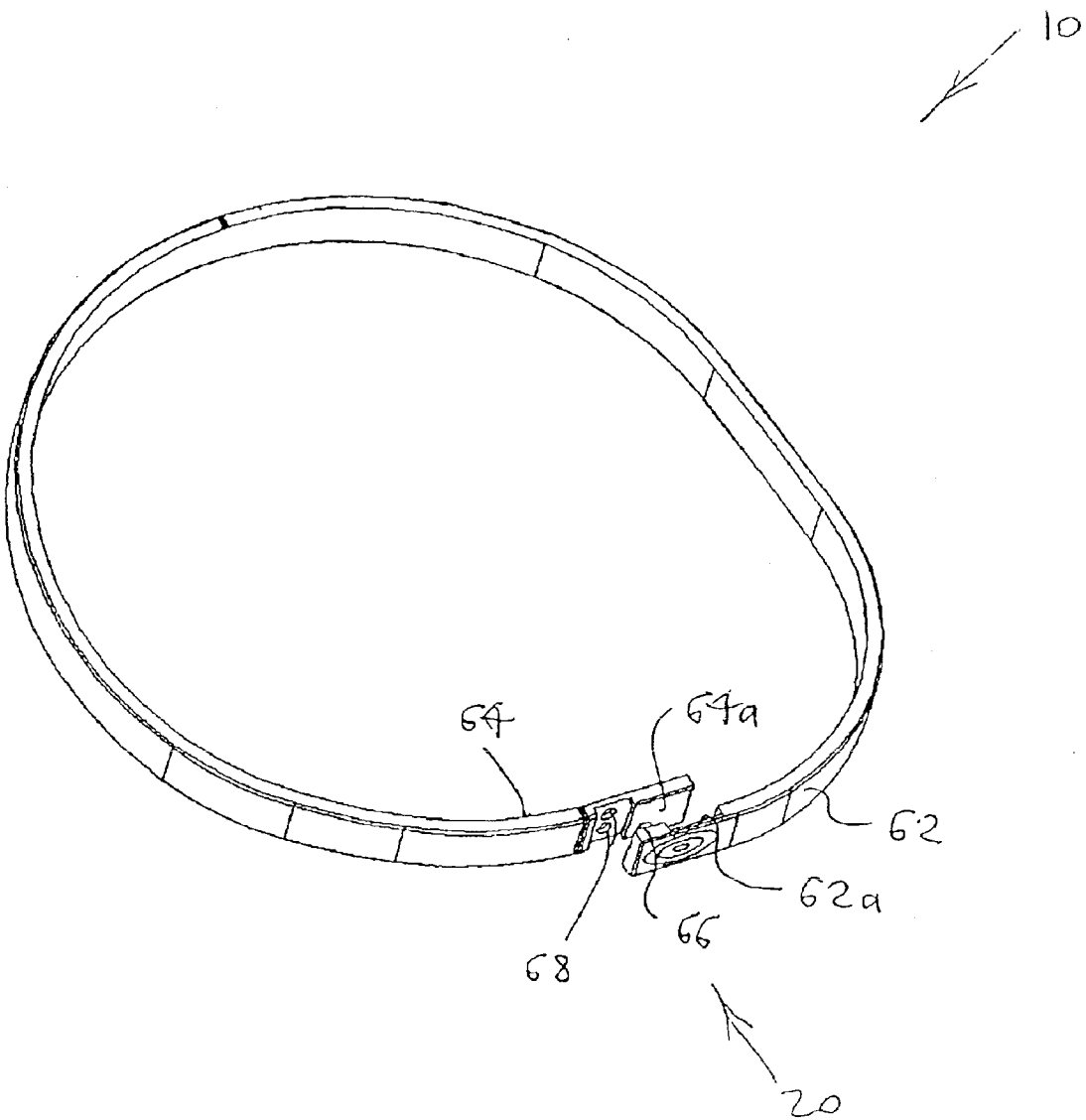
FIG. 14 is a perspective view as in FIG. 13, having the added feature of protruding studs in the outward belt end and correspondingly located recessed stud receiving bores in the inward belt end.
Figure 15:
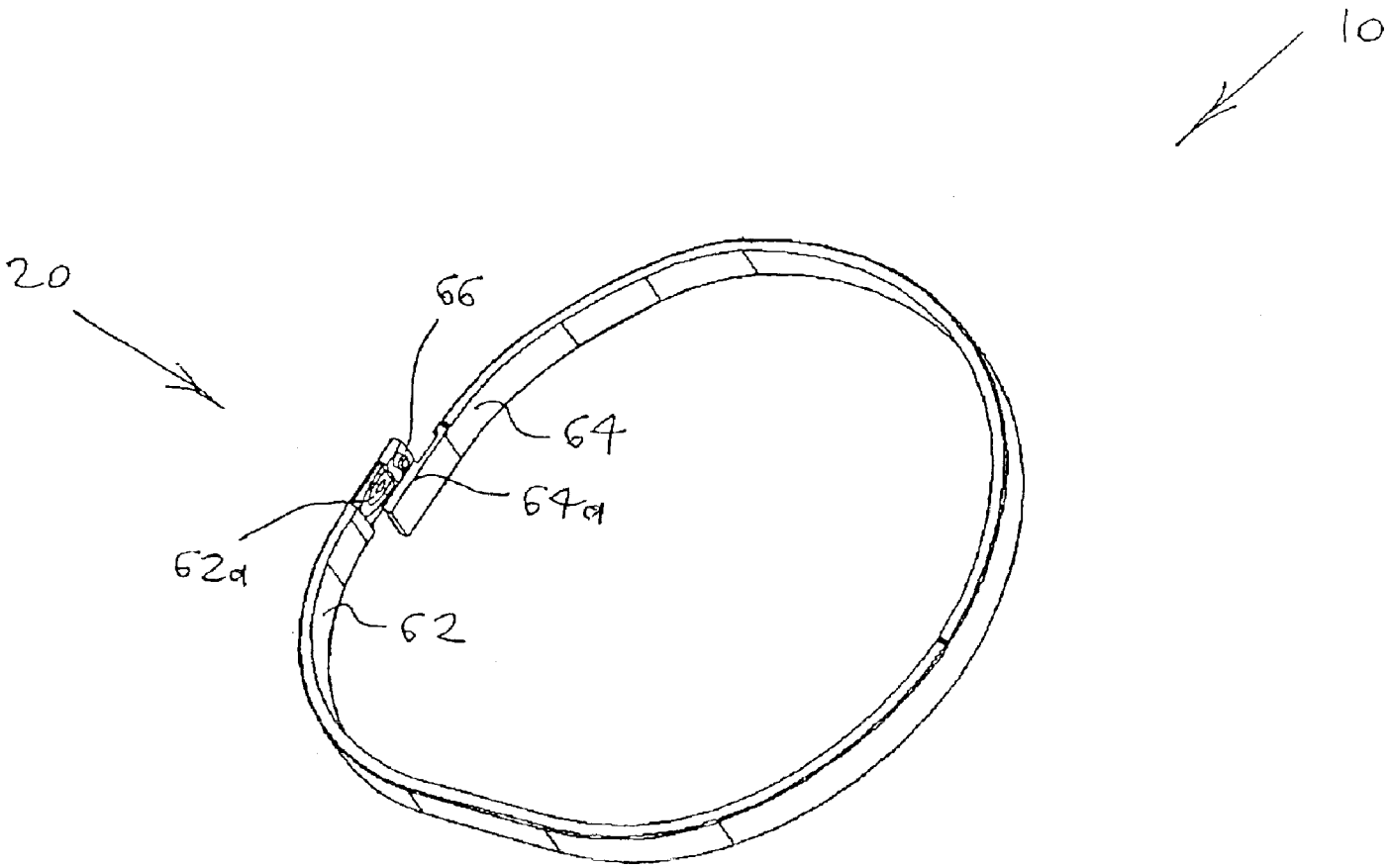
FIG. 15 is another perspective view of the belt of FIG. 14.

Yet another embodiment is that of a shirt 10 having a magnetic fastener 20 in place of buttons. Magnetic fastener 20 includes arm openings 12, a neck opening 34 and a forward section 30 with a conventional longitudinal slit 32 from neck opening 34 to the waist edge 36 defining an outward section end 42 secured to an outward magnetic strip 42*a* overlapping an inward section end 44 secured to a registering inward magnetic strip 44*a*. See FIG. 9. The outward magnetic strip 42*a* releasibly engages the inward magnetic strip 44*a* to hold the shirt forward section closed and the shirt 10 secure around the wearer upper torso. Alternatively the outward and inward magnetic strips 42 and 44, respectively, may be replaced with a series of correspondingly placed outward and inward magnetic strip segments or buttons 52 and 54, respectively, which are optionally circular, to have the general appearance of conventional buttons. FIGS. 10–12 show magnetic buttons 52 and 54 which are dish-shaped and have thread ports 56 for securing the magnetic buttons 52 and 54 to the outward and inward ends 42 and 44. Outward buttons 54 preferably have an ornamental cap 58 which releasibly snaps onto the dish-shaped portion 54 to be replaced with an ornamental cap 58 having a different appearance. See FIG. 12.

For all of these embodiments, it is understood that each of the meeting magnetic panels may actually be a magnet, or just one of them may be a magnet an the other may be a nonmagnet which is attracted by a magnetic field. Thus the term "magnetic" as used herein is understood to mean either a material which is magnetized or one which is simply attracted to magnetic fields, but at least one of the meeting panels or plates is a magnet. The magnetic strips and panels of the several embodiments may be formed of traditional ferromagnetic or ceramic magnet materials, but are preferably formed of the newer plastic magnet materials.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An article of clothing, comprising:

flexible clothing sheet material having first and second sheet material ends which separate to pass a portion of a wearer body into and out of the article of clothing;

and first and second magnetic fastener means which are magnetically attracted to each other and are secured to respective said first and second sheet material ends for releasibly securing said sheet material ends together and thus securing the article of clothing around a portion of the wearer body;

wherein said flexible clothing sheet material is configured to define a shoe comprising a shoe outer surface and a shoe upper section having two inner flaps pivoting toward each other and an outer flap pivotally secured to said shoe outer surface and pivotable over said inner flaps, and wherein said first and second magnetic fastener means comprise an inner flap magnetic panel on each said inner flap and an outer flap magnetic panel on said outer flap positioned to be adjacent to said inner flap magnetic panels when said outer flap is pivoted over said inner flaps.

2. The article of clothing of claim 1, comprising two said inner flaps pivoting toward each other, each having an inner magnetic flap magnetic panel, wherein said outer flap pivots over both of said two inner flaps such that said outer flap magnetic panel releasibly engages said inner flap magnetic panels.

3. The article of clothing of claim 1, wherein said flexible clothing sheet material is configured to define a shoe, comprising:

a shoe top region divided by a longitudinal slit defined by two opposing slit edges, each slit edge having a series of adjacent shoelace passing ports;

and at least one shoelace threaded through opposing said shoelace passing ports;

wherein said first and second magnetic fastener means comprise shoelace magnetic tip elements on said shoelace;

a shoelace tip engaging magnetic structure secured to said shoe top region for releasibly receiving and magnetically engaging said magnetic tip elements.

* * * * *